US007796150B2

(12) United States Patent
Tamaoki

(10) Patent No.: US 7,796,150 B2
(45) Date of Patent: Sep. 14, 2010

(54) IMAGE FORMING APPARATUS WITH MULTI-COLOR DOT IMAGE FORMATION

(75) Inventor: Tomohiro Tamaoki, Moriya (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 11/762,345

(22) Filed: Jun. 13, 2007

(65) Prior Publication Data

US 2007/0285490 A1 Dec. 13, 2007

(30) Foreign Application Priority Data

Jun. 13, 2006 (JP) ..... 2006-163862

(51) Int. Cl.
*B41J 2/435* (2006.01)
*G03G 15/16* (2006.01)

(52) U.S. Cl. ..... 347/228; 399/296; 399/297

(58) Field of Classification Search ..... 347/140, 347/228, 240, 251–254; 399/6, 66, 227, 399/296, 297, 301, 308
See application file for complete search history.

(56) References Cited

U.S. PATENT DOCUMENTS 6,327,450 B1 * 12/2001 Ito ..... 399/227
6,944,418 B2 * 9/2005 Tamaoki ..... 399/297
2005/0219623 A1 * 10/2005 Hiramoto et al. ..... 358/3.06

FOREIGN PATENT DOCUMENTS

| | | |
|---|---|---|
| JP | 11-052758 A | 2/1999 |
| JP | 2004-118076 A | 4/2004 |
| JP | 2004-151588 A | 5/2004 |

* cited by examiner

*Primary Examiner*—Hai C Pham
(74) *Attorney, Agent, or Firm*—Rossi, Kimms & McDowell LLP

(57) ABSTRACT

An image forming apparatus which can prevent degradation of image quality in a case where dot patterns for preventing the formation of image stripes are superimposed on respective developed images corresponding to image signals. Developed images are formed on a photosensitive drum using developers of respective different colors based on image information. The developed images formed on the photosensitive drum are transferred onto an intermediate transfer belt. For each of the developed images of the respective colors, a number of dot developed images which are minute dot-shaped images formed in a dispersed manner are transferred onto the intermediate transfer belt.

12 Claims, 9 Drawing Sheets

IMAGE FORMING APPARATUS WITH MULTI-COLOR DOT IMAGE FORMATION

BACKGROUND OF THE INVENTION

1. Field of the Invention

The present invention relates to a an image forming apparatus and an image forming method which sequentially form developed images of colors corresponding to image signals of respective colors and transfer the formed developed images in a superimposed manner onto a sheet.

2. Description of the Related Art

Conventionally, as an electrophotographic color image forming apparatus, there has been an image forming apparatus in which image forming sections are provided for respective colors. Each image forming section of this image forming apparatus is comprised of a photosensitive drum, an exposure device, and a developing device. In each image forming section, laser light modulated in accordance with image data of the corresponding color is irradiated from the exposure device onto the photosensitive drum. As a result, a latent image of the corresponding color is formed on the photosensitive drum. Then, the latent image formed on the photosensitive drum is visualized as a toner image of the corresponding color by the developing device. That is, the image forming sections form toner images of respective colors.

The toner images formed by the respective image forming sections are primarily transferred in a superimposed manner onto a sheet supported on an intermediate transfer member or a transfer conveying member by a primary transfer section (multilayer-transfer). In a case where an intermediate transfer member is used, toner images of respective colors multilayer-transferred onto the intermediate transfer member are collectively transferred onto the sheet by a secondary transfer section (secondary transfer). As the intermediate transfer member, an endless belt (intermediate transfer belt) is used in many cases.

To increase the latitude of transfer from the photosensitive drum to the intermediate transfer belt (transfer efficiency) in the image forming apparatus using the intermediate transfer belt as above, it is necessary to set the primary transfer current value to the optimum value. It is, however, difficult to set the primary transfer current value to the optimum value, and there may be cases where the primary transfer current value is set to be a low value or a high value. If the primary current value is lower than the optimum value, a transfer failure may occur, and if the primary current value is higher than the optimum value, this may cause retransfer.

To address this problem, a technique for increasing the primary transfer latitude by driving a photosensitive drum and a transfer belt in such a manner as to produce a difference in peripheral speed between them. In the case of this technique, such a shearing force as to scrape out a toner image on the photosensitive drum is produced between the photosensitive drum and the intermediate transfer belt due to the difference in peripheral speed, and the shearing force is used for primary transfer of the toner image. With this technique, improvement and stabilization of the primary transfer latitude can be accomplished, and variations in image density and dropout of a lines or a character image (in particular, dropout in the middle section of a thin line of a secondary color) are prevented. In the case of the above technique, however, the coefficient of friction varies to change the rotational speed of the photosensitive drum depending on whether or not toner exists between the photosensitive drum and the intermediate transfer belt since frictional force is constantly produced between the photosensitive drum and the intermediate transfer belt due to the difference in peripheral speed. As a result, the position of laser light irradiated on the photosensitive drum may change, which could form stripe-shaped images.

The above phenomenon also occurs in an image forming apparatus of the type that is comprised of a plurality of developing devices arranged for one photosensitive drum, sequentially forms toner images of corresponding colors on the photosensitive drum, and superimposes the toner images on an intermediate transfer member. The above phenomenon also occurs in a case where a toner image is transferred onto a sheet conveyed from a photosensitive drum while being supported by a transfer material conveying member.

To cope with this, a method which prevents the occurrence of the above phenomenon has been proposed for an image forming apparatus which drives a photosensitive drum and an intermediate transfer member or a transfer material conveying member in such a manner as to produce a difference in peripheral speed between them (see e.g. Japanese Laid-Open Patent Publication (Kokai) Nos. 2004-118076 and 2004-151588). In this method, a dot-dispersed image (dot pattern) which is an additional image comprised of dispersed dot toner images is superimposed on a toner image which is a normal image formed in accordance with an image signal of the corresponding color. As a result, a high-quality image with no stripes (image stripes) can be obtained.

Also, in the case of the arrangement in which a photosensitive drum and an intermediate transfer member or a transfer material conveying member are driven in such a manner as to produce no difference in peripheral speed between them, an unexpected speed difference may be produced between them, which could cause a color shift. For such an arrangement, the above described method in which a dot-dispersed image (dot pattern) comprised of dispersed dot toner images is superimposed on a toner image which is a normal image is useful.

Incidentally, image forming apparatuses of an electrophotographic type using toners of four or more colors have been proposed in recent years. In such image forming apparatuses, light color toners such as light cyan toner and light magenta toner are used in addition to toners of four colors, i.e. cyan, magenta, yellow, and black (see e.g. Japanese Laid-Open Patent Publication (Kokai) No. H11-52758). By using such light color toners, a high-quality image with decreased graininess can be obtained.

Such multicolor image forming apparatuses are required to form higher-quality images as compared with conventional four-color image forming apparatuses. However, if the conventional method in which a dot pattern which is an additional image comprised of dot dispersed toner images is superimposed on a toner image which is a normal image is used, the tint of an image may change; for example, areas with low density take on a yellow tinge. Thus, high-quality images desired by users may not be provided, and what is even worse, image quality may be degraded.

SUMMARY OF THE INVENTION

The present invention provides an image forming apparatus and an image forming method which can prevent degradation of image quality in a case where dot patterns for preventing the formation of image stripes are superimposed on respective developed images corresponding to image signals.

In a first aspect of the present invention, there is provided an image forming apparatus comprising an image forming unit adapted to form developed images on an image carrier using developers of respective different colors based on image information, and an intermediate transfer member onto which the developed images formed on the image carrier are transferred, and, with respect to each of the developed images formed using the developers of the respective different colors, the image forming unit transfers a number of dot developed images that are minute dot-shaped images formed in a dispersed manner onto the intermediate transfer member.

In a second aspect of the present invention, there is provided an image forming apparatus comprising an image forming unit adapted to form developed images on an image carrier based on image information, an intermediate transfer member onto which the developed images formed on the image carrier are transferred, and a transfer unit adapted to transfer the developed images from the intermediate transfer member onto a transfer member, and the image forming unit forms a dot-dispersed image comprising dot developed images each formed in an area of one or a plurality of dots using developers of at least two different colors onto the intermediate transfer member.

The dot developed images can be formed in the dispersed manner are formed in such a manner that the dot developed images are not overlapped.

There can be a difference in peripheral speed between a rotational speed of the image carrier included in the image forming unit and a surface movement speed of the intermediate transfer member.

The developed images formed using the developers of the respective different colors can comprise at least one of a yellow developed image, a light magenta developed image, and a light cyan developed image.

In a third aspect of the present invention, there is provided an image forming apparatus comprising an image forming unit adapted to sequentially form developed images of respective colors in accordance with image signals of the respective colors, a transfer unit adapted to transfer the developed images of the respective colors in a superimposed manner onto a sheet, and a dot pattern generating unit adapted to determine positions at which a plurality of dot-based developed images constituting dot patterns having the same colors as and superimposed on respective developed images of at least two colors among the developed images of the respective colors are to be formed, and generate a dot pattern signal indicative of the determined positions at which the plurality of dot-based developed images are to be formed, and, in forming the developed images of at least two colors, the image forming unit forms the dot-based developed images of the same colors as the respective colors of the developed images at the respective determined positions in accordance with the dot pattern signal generated by the dot pattern generating unit.

The dot pattern generating unit can determine the positions at which the dot-based developed images are to be formed in the dot patterns of the respective colors superimposed on the respective developed images of at least two colors in such a manner that the dot-based developed images are not overlapped.

The developed images of at least two colors on which the dot patterns of the same colors as the respective colors of the developed images are superimposed can comprise at least two of a yellow developed image, a light magenta developed image, and a light cyan developed image.

In a fourth aspect of the present invention, there is provided an image forming method of sequentially forming developed images of respective colors in accordance with image signals of the respective colors and transferring the developed images of the respective colors in a superimposed manner onto a sheet, the method comprising a dot pattern generating step of determining positions at which a plurality of dot-based developed images constituting dot patterns having the same colors as and superimposed on respective developed images of at least two colors among the developer mages of the respective colors are to be formed, and generating a dot pattern signal indicative of the determined positions at which the plurality of dot-based developed images are to be formed, and a dot pattern forming step of, in forming the developed images of at least two colors, forming the dot-based developed images of the same colors as the respective colors of the developer mages at the respective determined positions in accordance with the dot pattern signal generated in the dot pattern generating step.

In the dot pattern generating step, the positions at which the dot-based developed images are to be formed in the dot patterns of the respective colors superimposed on the respective developed images of at least two colors can be determined in such a manner that the dot-based developed images are not overlapped.

The developed images of at least two colors on which the dot patterns of the same colors as the respective colors of the developed images are superimposed can comprise at least two of a yellow developed image, a light magenta developed image, and a light cyan developed image.

According to the present invention, a number of dot developed images which are minute dot-shaped images are formed in a dispersed manner on the surface of an intermediate transfer member with respect to each of developed images of different colors, and as a result, degradation of image quality can be prevented in a case where dot patterns for preventing the occurrence of image stripes are superimposed on respective developed image corresponding to image signals.

Further features of the invention will become apparent from the following detailed description of exemplary embodiments with reference to the attached drawings.

DETAILED DESCRIPTION OF THE PREFERRED EMBODIMENTS

The present invention will now be described in detail with reference to the drawings showing a preferred embodiment thereof.

Figure 1:
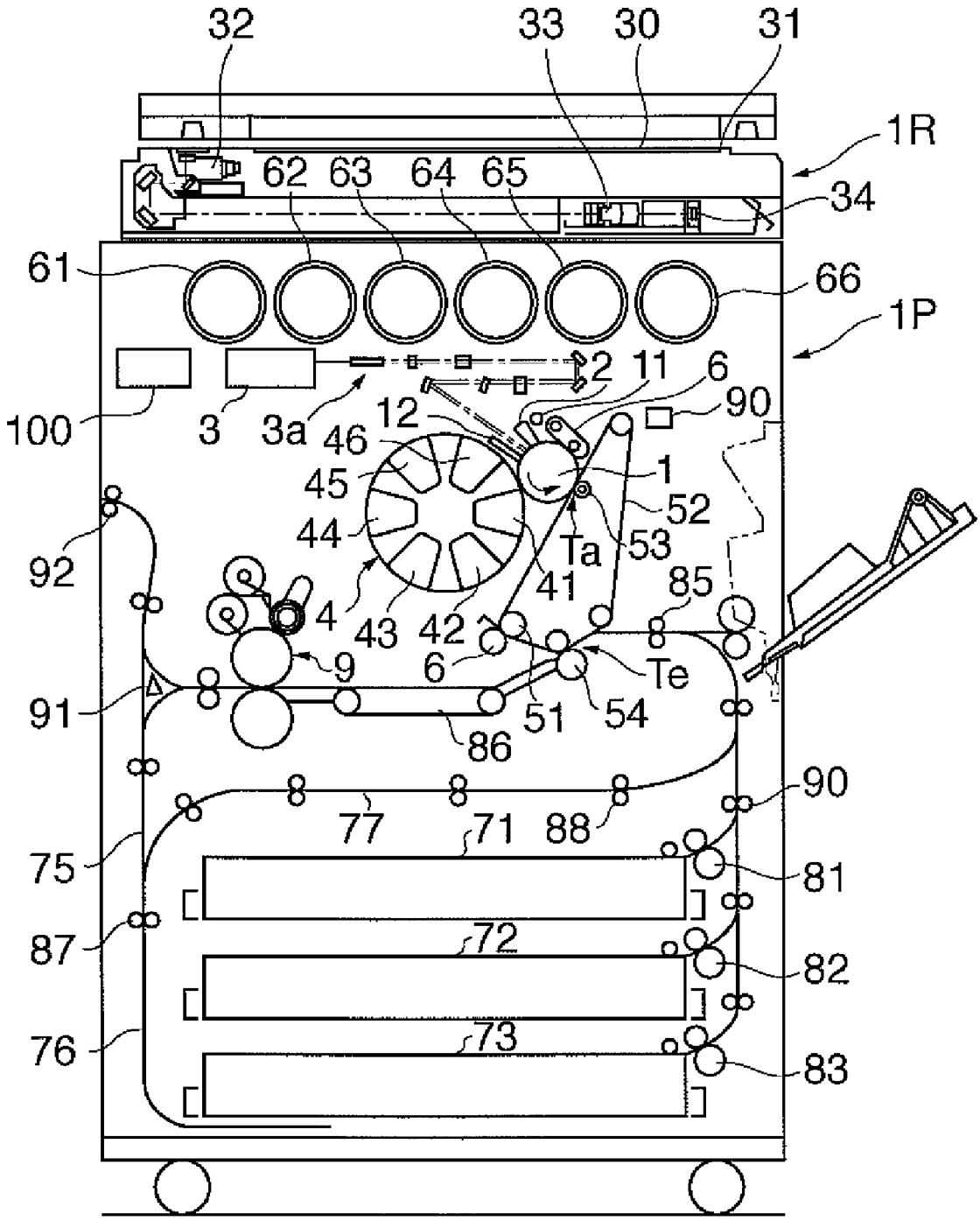
FIG. 1 is a longitudinal sectional view showing the construction of an image forming apparatus according to an embodiment of the present invention.

FIG. 1 is a longitudinal sectional view showing the construction of an image forming apparatus according to an embodiment of the present invention.

As shown in FIG. 1, the image forming apparatus is a full-color image forming apparatus capable of forming full-color images using toners of six colors, Y (yellow), M (magenta), C (cyan), K (black), light M (hereinafter referred to as "LM") and light C (hereinafter referred to as "LC"). As shown in FIG. 1, the image forming apparatus is comprised of a reader section 1R capable of reading color images, and a printer section 1P capable of printing out full-color images.

The reader section 1R scans in an original 30 placed on an original platen glass 31 by exposing the original 30 to light from en exposure lamp 32 and causes reflected light from the original 30 to form an optical image on a full-color CCD sensor (hereinafter referred to as "the CCD") 34 via reflection mirrors and a lens 33. The CCD 34 converts the optical image into R, G, and B signals and outputs them. The R, G, and B signals are subjected to predetermined image processing performed by an image processing section (see FIG. 4), described later, and then temporarily stored as LM, LC, Y, M, C, and K image signals in an image memory. The LM, LC, Y, M, C, and K image signals are read out from the image memory and input to the printer section 1P. The printer section 1P receives image signals from an external computer (PC), image signals from a facsimile apparatus (FAX), as well as the above-mentioned signals from the reader section 1R.

The printer section 1P is comprised of a photosensitive drum 1 which is rotatively driven in a direction indicated by an arrow in FIG. 1, an exposure device 3, and an intermediate transfer belt 52. A preexposure lamp 11, a corona primary charger 2, a potential sensor 12, a developing rotary 4, and a cleaner 6 are disposed around the photosensitive drum 1.

The preexposure lamp 11 is for removing electricity from the surface of the photosensitive drum 1. The corona primary charger 2 is for uniformly charging the surface of the photosensitive drum 1 to a predetermined potential. The potential sensor 12 measures the surface potential of the photosensitive drum 1.

The developing rotary 4 holds six developing devices 41 to 46 filled with toners having different spectroscopic characteristics and is rotatively driven to position an appropriate one of the developing devices 41 to 46 to a developing position determined in advance with respect to the photosensitive drum 1. Here, the developing device 41 is filled with light magenta toner (hereinafter referred to as "LM toner"), and the developing device 42 is filled with light cyan toner (hereinafter referred to as "LC toner"). The developing device 43 is filled with yellow toner (hereinafter referred to as "Y toner"); the developing device 44, dark magenta toner (hereinafter referred to as "M toner") having the same tint as and a different density from the LM toner; and the developing device 45, dark cyan toner (hereinafter referred to as "C toner") having the same tint as and a different density from the LC toner. The developing device 46 is filled with black toner (hereinafter referred to as "K toner"). When positioned at the above-mentioned developing position, each of the developing devices 41 to 46 operates to supply toner stored therein to the photosensitive drum 1.

As a toner that fills each of the developing devices 41 to 46, either a two-component developer in which a toner and a carrier are mixed or a one-component developer comprised only of a toner may be used. Although in the above description, a combination of the LC toner and the LM toner is used as a combination of toners having different blightnesses, the present invention is not limited to this, but only LC toner, only LM toner, or only Y toner may be used. Thus, to accomplish the principle of the present invention, the number of developing devices has only to be at least four, although it is assumed that the number of developing devices is six in the present embodiment.

Toner is added to the developing devices 41 to 46 by corresponding toner containers (hoppers) 61 to 66 as the need arises so that the ratio of toner (or the quantity of toner) in the developing devices 41 to 46 can be kept constant.

The cleaner 6 is for removing toner remaining on the photosensitive drum 1.

The exposure device 3 drives a light source, not shown, in accordance with an input image signal and causes the light source to emit laser light. The laser light is swung in the main scanning direction by a scanning optical system 3*a* so as to scan the surface of the photosensitive drum 1 by exposing it.

With the above described arrangement, in forming an image, after the photosensitive drum 1 is rotated in the direction indicated by the arrow, electricity is removed from the surface of the photosensitive drum 1 by the preexposure lamp 11, and then the surface of the photosensitive drum 1 is uniformly charged by the primary charger 2. The exposure devices 3 then exposes and scans in the photosensitive drum 1 using laser light corresponding to an image signal of a corresponding color. As a result, an electrostatic latent image of the corresponding color is formed on the photosensitive drum 1. The developing rotary 4 is rotatively driven in such a manner that the developing device of the corresponding color reaches the developing position, and toner of the corresponding color is supplied from the developing device of the corresponding color to the photosensitive drum 1. The supplied toner visualizes the electrostatic latent image formed on the photosensitive drum 1 as a toner image. The toner image formed on the photosensitive drum 1 is primarily transferred onto the intermediate transfer belt 52 by a primary transfer roller 53 (primary transfer section Ta). After the primary transfer, the cleaner 6 cleans the surface of the photosensitive drum 1 so as to remove remaining toner.

The sequence from the removal of electricity by the preexposure lamp 11 to cleaning by the cleaner 6 via the primary transfer is repeatedly carried out for the respective colors, and toner images of the respective colors are sequentially transferred in a superimposed manner onto the intermediate transfer belt 52. As a result, a full-color toner image is formed on the intermediate transfer belt 52. The intermediate transfer belt 52, which is driven by a drive roller 51, runs between a plurality of rollers including the drive roller 51. A transfer cleaning device 56 for cleaning the surface of the intermediate transfer belt 52 is disposed at a location opposed to the drive roller 51 with the intermediate transfer belt 52 interposed therebetween. The transfer cleaning device 56 moves in such a manner as to come into contact with and leave from the intermediate transfer belt 52. Also, a photo-sensor 90 for reading a patch image on the intermediate transfer belt 52 is provided. An output from the photo-sensor 90 is used in detecting the amount of toner on the intermediate transfer belt 52.

Assuming that image formation is carried out using toners of six colors, toner images are formed in the following order: a toner image formed by LM toner, a toner image formed by LC toner, a toner image formed by Y toner, a toner image formed by M toner, a toner image formed by C toner, and a toner image formed by K toner. These toner images are superimposed in the order in which they were formed and transferred onto the intermediate transfer belt 52. Finally, a full-color toner image of the six colors is formed on the intermediate transfer belt 52.

After all the toner images of necessary colors have been transferred onto the intermediate transfer belt 52 to form a full-color toner image as above, the full-color toner image is transferred onto a fed sheet (transfer material) at a secondary transfers section Te by a secondary transfer roller 54. The secondary transfer roller 54 is kept away from the intermediate transfer belt 52 until the primary transfer of all the toner images of necessary colors is completed, and in secondary transfer timing, the secondary transfer roller 54 is moved to abut on the intermediate transfer belt 52. After the secondary transfer, the transfer cleaning device 56 is caused to abut on the surface of the intermediate transfer belt 52, and the surface of the intermediate transfer belt 52 is cleaned by the transfer cleaning device 56. As a result, toner remaining on the surface of the intermediate transfer belt 52 is removed.

The sheet is fed from any of housing sections 71, 72, and 73 to any of sheet feed roller pairs 81, 82, and 83 and fed toward a registration roller pair 85. The registration roller pair 85 corrects for the skew of the sheet and then feeds the sheet toward the secondary transfer section Te in synchronization with timing in which the toner image on the intermediate transfer belt 52 is transferred onto the sheet. At the secondary transfer section Te, the toner image on the intermediate transfer belt 52 is transferred onto the sheet as mentioned above. The sheet onto which the toner image has been transferred is conveyed to a fixing device 9 via a conveying belt 86. The fixing device 9 applies thermal pressure to the toner image on the sheet when the sheet passes the fixing device 9, whereby the toner image is fixed on the sheet.

The sheet having passed the fixing device 9 is fed to a pair of sheet discharge rollers 92 or a conveying path 75 by a flapper 91. In a case where the sheet is conveyed to a discharged sheet tray or a postprocessing apparatus such as a sorter, the sheet is conveyed toward the sheet discharge roller pair 92. In the case of a double-side printing mode in which images are formed on both sides of a sheet, the sheet is conveyed toward the conveying path 75.

The sheet conveyed to the conveying path 75 is conveyed once into an inversion path 76 and then fed to a double-sided path 77 by inversion of the conveying roller 87. As a result, the image-formed surface of the sheet is inverted from the front side to the reverse side, and the sheet with its image-formed surface inverted is conveyed toward a double-sided conveying roller pair 88 via the double-sided path 77. After correcting for the skew of the sheet, the double-sided conveying roller pair 88 feeds the sheet to the registration roller pair 85 again. By the above described image forming process, an image is formed on the reverse side of the sheet, which is then discharged to the discharged sheet tray or the postprocessing apparatus.

The reader section 1R and the printer section 1P of the image forming apparatus according to the present embodiment are controlled by a controller 100. The controller 100 is comprised of a CPU, a ROM, a RAM, an I/O (input/output interface), and so on, and controls an original reading operation carried out by the reader section 1R, an image forming operation carried out by the printer section 1P, and so on in accordance with a copy start signal from an operating section, not shown.

In the present embodiment, the rotational speed of the intermediate transfer belt 52 is set to be about several % higher than that of the photosensitive drum 1 so as to increase the latitude of primary transfer. That is, the intermediate transfer belt 52 and the photosensitive drum 1 are driven in such a manner as to produce a difference in peripheral speed between them. If there is a difference in peripheral speed between the intermediate transfer belt 52 and the photosensitive drum 1, frictional force is produced between them as described above. Such frictional force varies depending on whether or not toner exists between the intermediate transfer belt 52 and the photosensitive drum 1, and as a result, the rotational speed of the photosensitive drum 1 changes. The change in the rotational speed of the photosensitive drum 1 displaces the position of exposure on the photosensitive drum 1 by laser light, and stripes may appear in an image, more particularly, stripes may appear at the leading end of an image. This is because the rotational speed of the photosensitive drum 1 changes when the position on the photosensitive drum 1 changes from a non-image forming area to an image forming area, i.e. an image writing start position.

In the present embodiment, when a toner image (normal toner image) is formed based on image data of the corresponding color, a toner image is formed by superimposing a normal toner image and a dot pattern of the same color so as to prevent the formation of image stripes. Hereinafter, such a toner image formed by superimposing a dot pattern and a normal toner image will be referred to as a toner image with a dot pattern. Here, a dot pattern is comprised of a plurality of toner images (hereinafter referred to as "dot toner images") each comprised of a dot, that is, minute dot toner images diffused over the entire area corresponding to a sheet size. These dot toner images are positioned in such a manner that they are not on the same straight lines with respect to the sub-scanning direction. This aims to prevent the situation where dot toner images transferred onto a sheet are conspicuous when they are arranged on the same straight lines with respect to the sub-scanning direction. This also aims to prevent formation of stripes and smudges on the surface of the secondary transfer roller 54 and further prevent accumulation of an excessive amount of toner at a particular position of the cleaning device 6.

A toner image with a dot pattern as mentioned above is formed when a multi-color image such as a full-color image is formed. In the present embodiment, it is arranged such that a toner image with a dot pattern is formed for each of three colors LM, LC, and Y. For example, in forming a full-color image, first, toner images with dot patterns are sequentially formed and primarily transferred for the respective three colors LM, LC, and Y. After that, normal images (toner images based on image data of colors M, C, and K) are formed and primarily transferred for the respective colors M, C, and K.

If a toner image with a dot pattern is formed in the above-described manner, toner exists between the intermediate transfer belt 52 and the photosensitive drum 1 from the instant when the leading end of an area in which the toner image with the dot pattern is formed reaches the primary transfer area Ta. Thus, it is possible to prevent the state between the transfer belt 52 and the photosensitive drum 1 from abruptly changing from the state in which no toner exists to the state in which toner exists until the area in which the toner image with the dot pattern leaves the primary transfer area Ta. As a result, it is possible to reduce changes in the rotational speed of the photosensitive drum 1 and to form stable images with no stripes.

Figure 2:
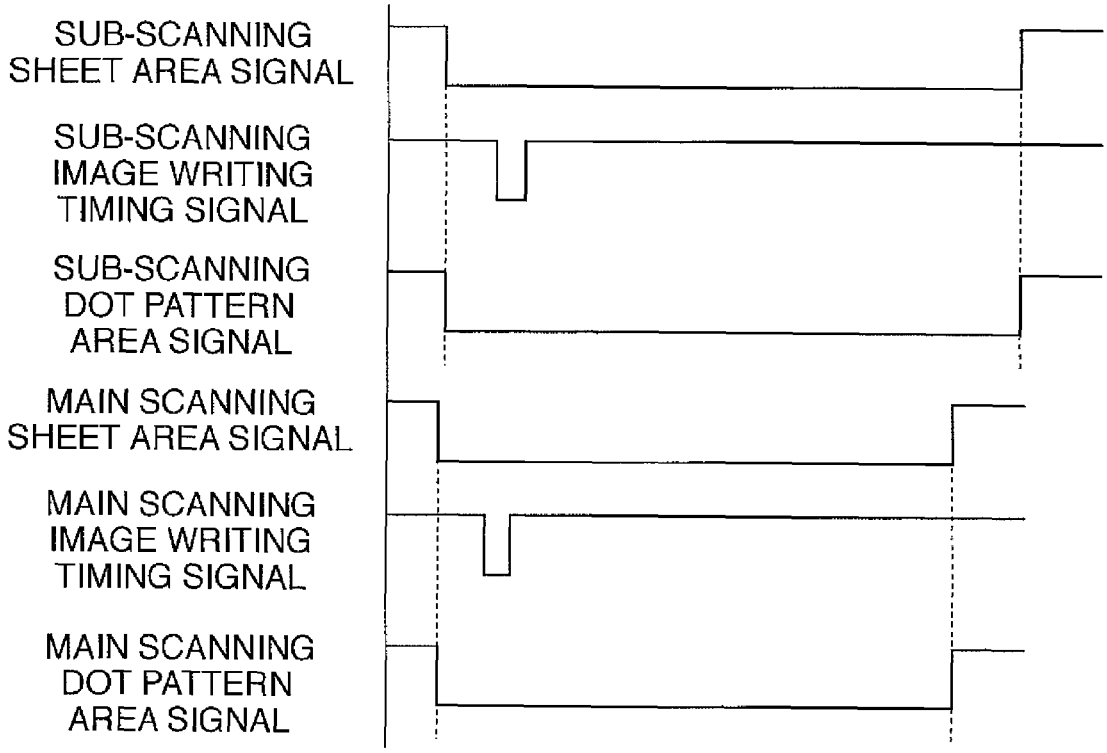
FIG. 2 is a timing chart in a case where a toner image with a dot pattern is formed by the image forming apparatus in FIG. 1.
Figure 3:
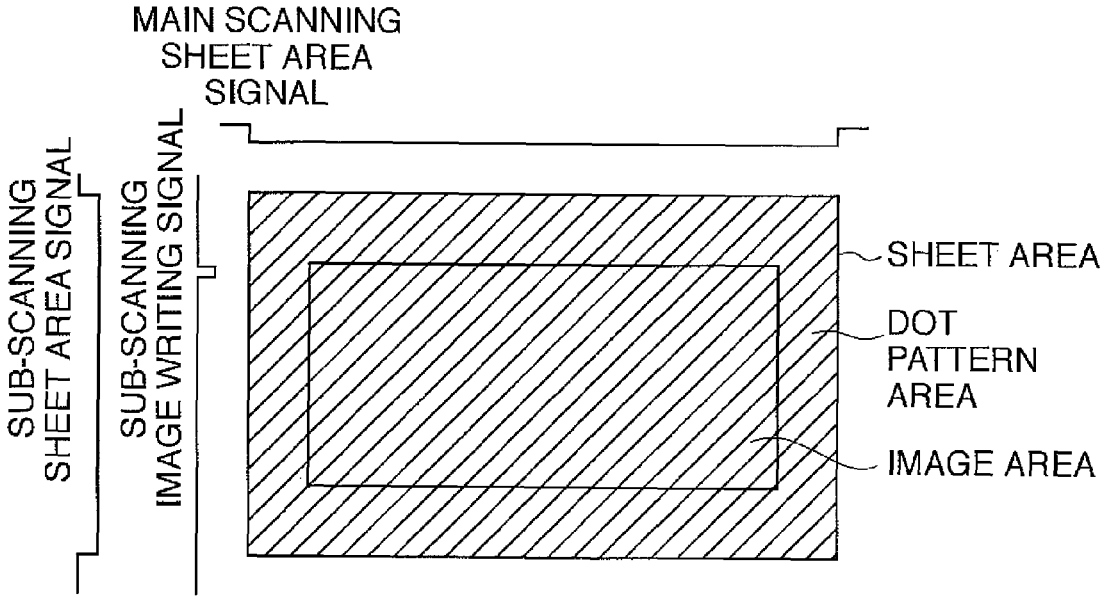
FIG. 3 is a plan view showing an area in which a toner image with a dot pattern is formed.
Figure 4:
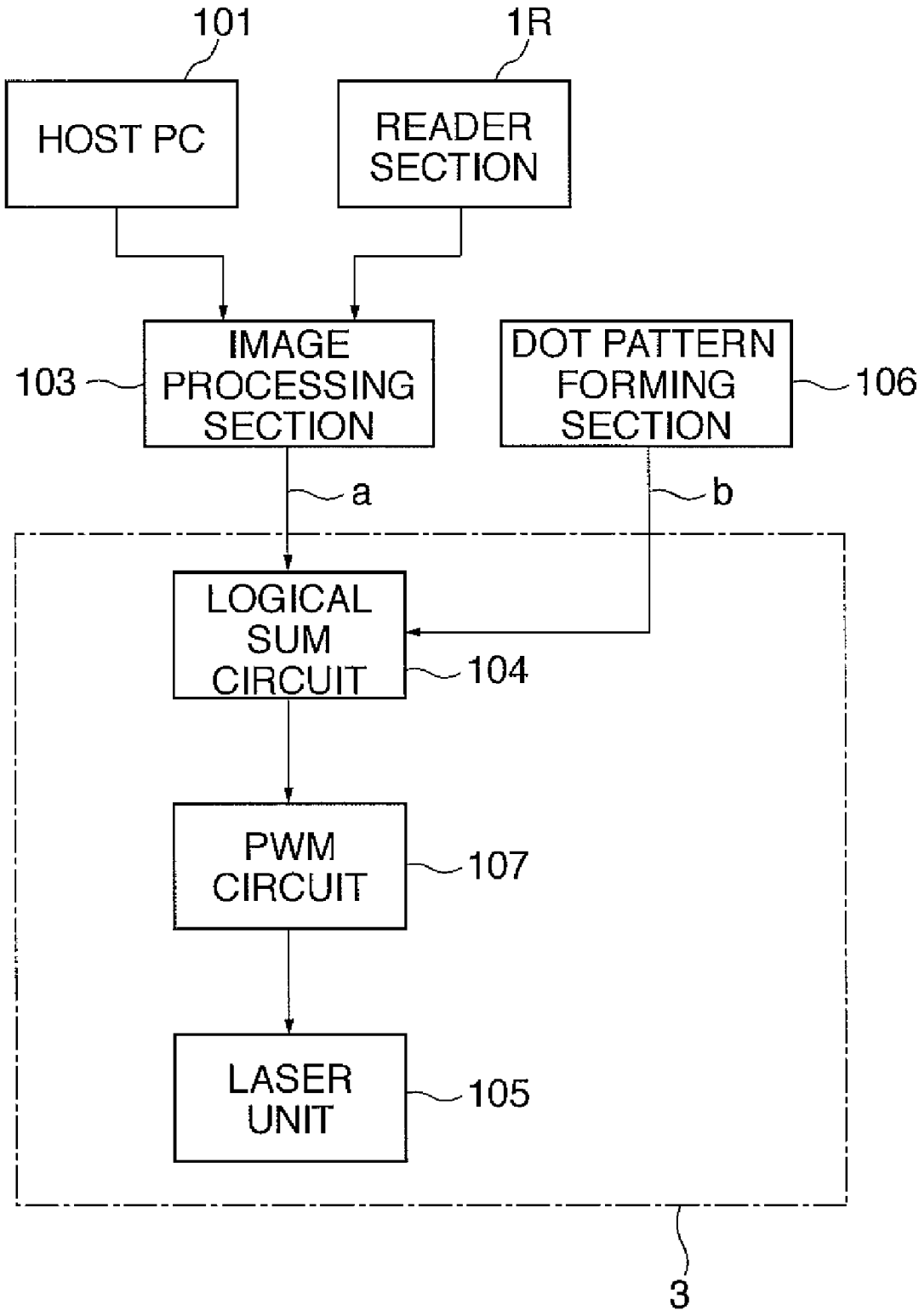
FIG. 4 is a block diagram showing a circuit configuration for forming a toner image with a dot pattern.
Figure 5:
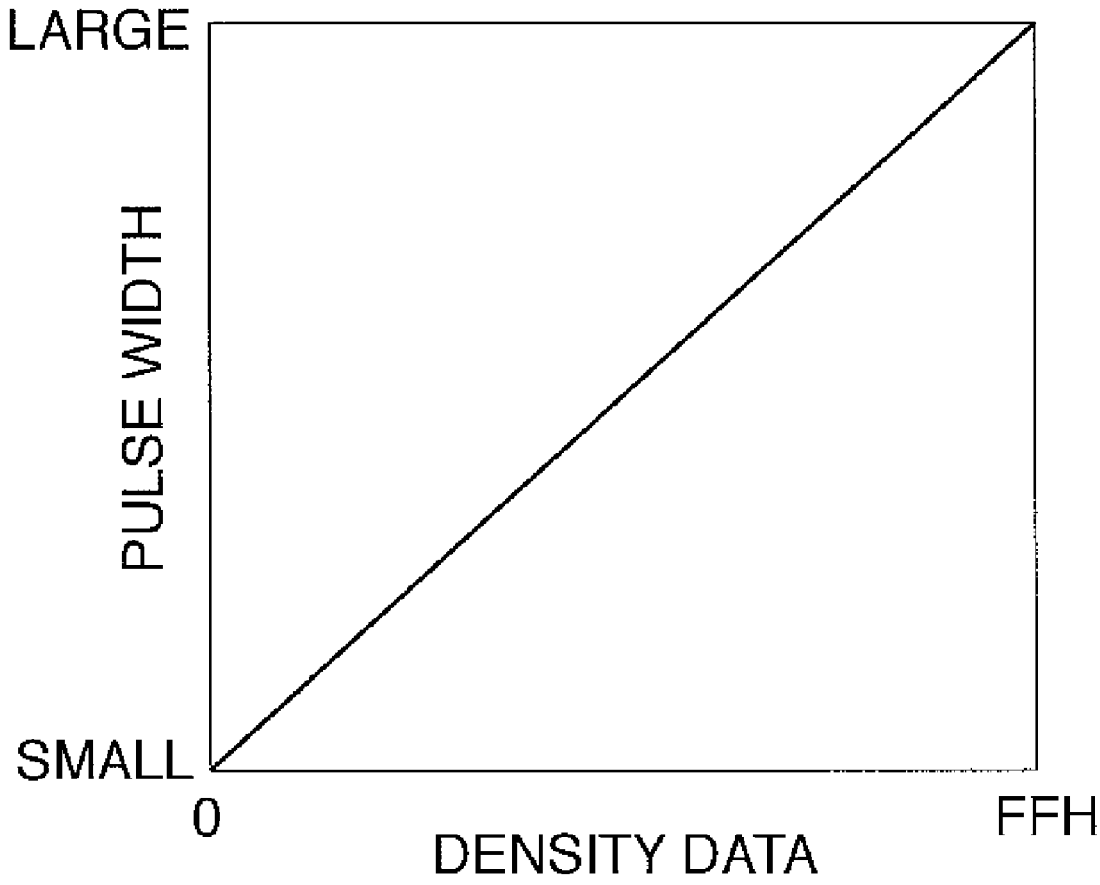
FIG. 5 is a view showing the relationship between density value and pulse width in a PWM table.

Referring next to FIGS. 2 to 5, a description will be given of how a toner image with a dot pattern is formed by superimposing a dot pattern and a normal toner image. FIG. 2 is a timing chart in a case where a toner image with a dot pattern is formed by the image forming apparatus in FIG. 1. FIG. 3 is a plan view showing an area in which a toner image with a dot pattern is formed. FIG. 4 is a block diagram showing a circuit configuration for forming a toner image with a dot pattern. FIG. 5 is a view showing the relationship between density value and pulse width in a PWM table.

In forming a toner image with a dot pattern, a sub-scanning sheet area signal is output first as shown in FIG. 2. The sub scanning sheet area signal is indicative of a fed sheet in the sub-scanning direction. In synchronization with outputting of the sub-scanning sheet area signal, a sub-scanning dot pattern area signal is output. The sub-scanning dot pattern area signal is a signal indicative of the timing in which the formation of a dot pattern with respect to the sub-scanning direction is started. After that, a sub-scanning image writing timing signal is a signal indicative of the timing in which the formation of a normal toner image with respect to the sub-scanning direction is started is output.

Regarding the main scanning direction, a main scanning sheet area signal is output. The main scanning sheet area signal is a signal indicative of the length of a fed sheet in the main-scanning direction. In synchronization with outputting of the main scanning sheet area signal, a main scanning dot pattern area signal is output. The main scanning dot pattern area signal is a signal indicative of the timing in which the formation of a dot pattern with respect to the main scanning direction is started. After that, a main scanning image writing start timing signal indicative of the timing in which the formation of a normal toner image with respect to the main scanning direction is started is output.

In the above described timing, a toner image with a dot pattern is formed for each corresponding color. In the formation of a toner image with a dot pattern, a dot pattern is formed before a normal toner image is formed. That is, a dot pattern and a normal toner image are superimposed to form a toner image with a dot pattern on the photosensitive drum 1 as shown in FIG. 3. Here, an area in which the dot pattern is formed covers the diagonally shaded area in FIG. 3 (sheet area), i.e. the entire area corresponding to the size of a fed sheet. On the other hand, the normal toner image is formed within an image area (rectangular area within the sheet area) corresponding to an image-formed area on the sheet. The image area is defined by the main scanning image writing signal and the sub-scanning image writing signal. Thus, in the image area, the dot pattern is superimposed on the normal toner image.

When a toner image with a dot pattern on the photosensitive drum 1 is transferred onto the intermediate transfer belt 52 (primary transfer), toner always exists between the photosensitive drum 1 and the intermediate transfer belt 52. Thus, changes in the coefficient of friction between the intermediate transfer belt 52 and the photosensitive drum 1 can be reduced.

Here, dot toner images have only to exist in an area between an end of the toner mage with the dot pattern (the position at which the formation of the dot pattern in the sub-scanning direction is started) and an end of the normal toner image (the position at which the formation of the normal toner image in the sub-scanning direction is started). More preferably, toner exists at the boundary between the dot pattern and the normal toner image.

In the present embodiment, toner images with dot patterns are formed using three colors LM, LC, and Y. After being transferred onto a sheet, one-dot toner images formed using light color toners (LM and LC) are less likely to stand out as compared with one-dot toner images formed using other color toners (M, C, and K). Since dot toner images of the three colors LM, LC, and Y are formed in a diffused manner, they have a color close to gray when they have been superimposed. Thus, as compared with the conventional technique of forming dot toner images using only one color Y, superimposed dot toner images of the three colors LM, LC, and Y are less likely to stand out on a sheet. Also, since dot toner images are formed using the three colors, i.e. the light color toners (LM and LC toners) and the Y toner, and hence it is only necessary to reduce changes in frictional force when forming images of dark color toner, only toner of a single color is not excessively consumed.

In the image forming apparatus according to the present embodiment, an image signal is input from a host PC (external computer) 101 or the reader section 1R to an image processing section 103 as shown in FIG. 4. The image processing section 103 performs predetermined processing on the input image signal to generate image signals of respective colors LM, LC, Y, M, C, and K. Each of the generated image signals of the respective colors is input as a normal image signal a to the exposure device 3. The normal image signal a of each color includes density information.

The exposure device 3 includes a logical sum circuit 104. The logical sum circuit 104 receives the normal image signal a and a dot pattern signal b generated by a dot pattern forming section 106. The dot pattern signal $\underline{b}$ is for forming a dot pattern and indicative of a value "0" or "1." The logical sum circuit 104 outputs an image density value based on the value of the dot pattern signal $\underline{b}$. Specifically, when the dot pattern signal $\underline{b}$ is indicative of the value "0", a density value A indicated by the density information included in the normal image signal a is output to a PWM circuit 107. On the other hand, when the dot pattern signal $\underline{b}$ is indicative of the value "1", a density value B for a dot pattern is output to the PWM circuit 107.

By referring to a PWM table in FIG. 5, the PWM circuit 107 generates a pulse width signal having a pulse width corresponding to the density value output from the logical sum circuit 104 and outputs the generated pulse width signal to a laser unit 105. The PWM table shows the relationship between density value and pulse width. The laser unit 105 turns on and off a laser light source, not shown, in accordance with the pulse width signal. Laser light emitted from the laser light source exposes and scans the photosensitive drum 1, whereby an electrostatic latent image corresponding to an image signal of a corresponding color is formed on the photosensitive drum 1. The electrostatic latent image is developed by a developing device of the corresponding color, and a toner image of the corresponding color is formed on the photosensitive drum 1. This toner image is formed by superimposing a dot pattern on a normal toner image as shown in FIG. 3 referred to above.

Figure 6:
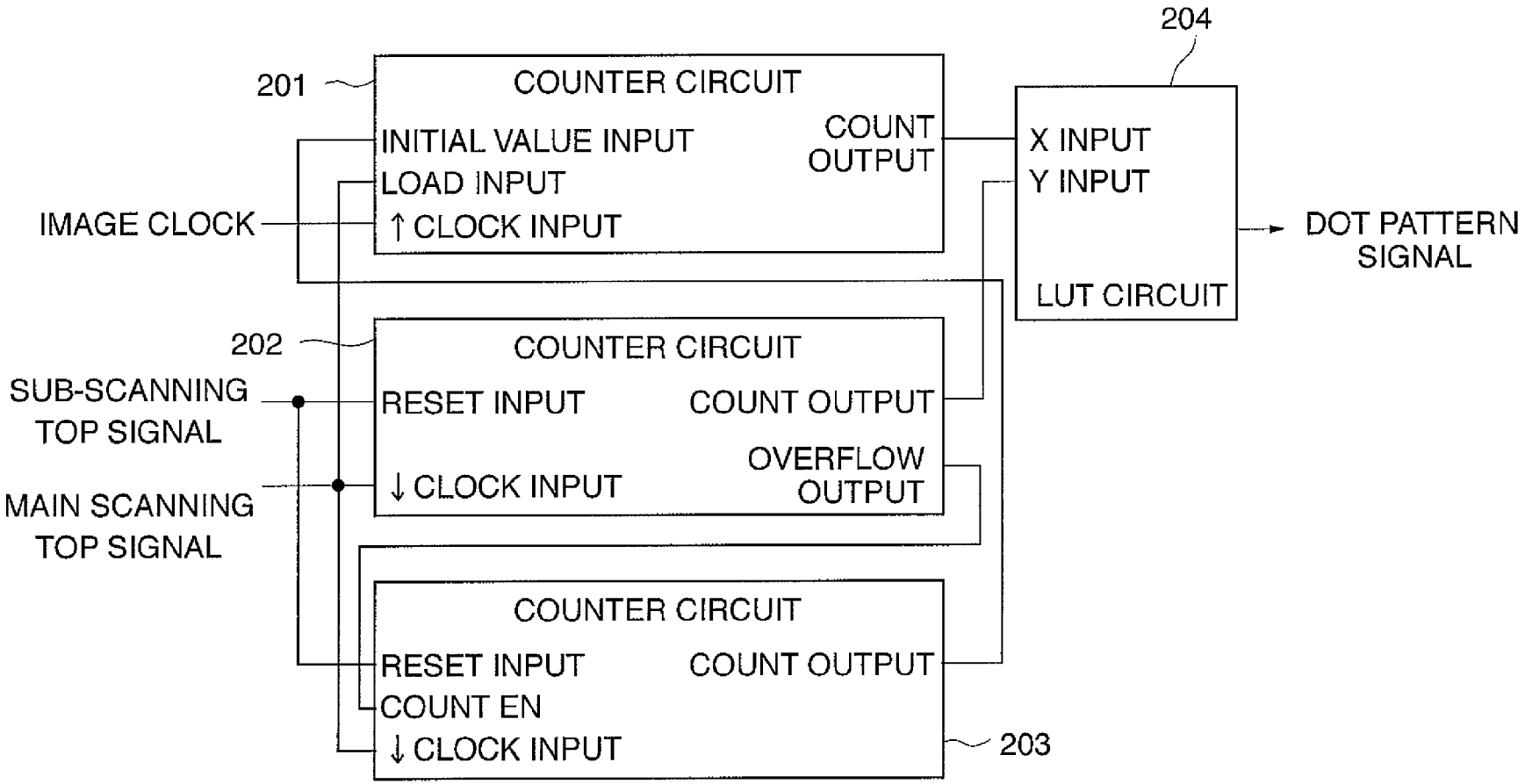
FIG. 6 is a block diagram showing the construction of a dot pattern forming section appearing in FIG. 4.
Figure 7:
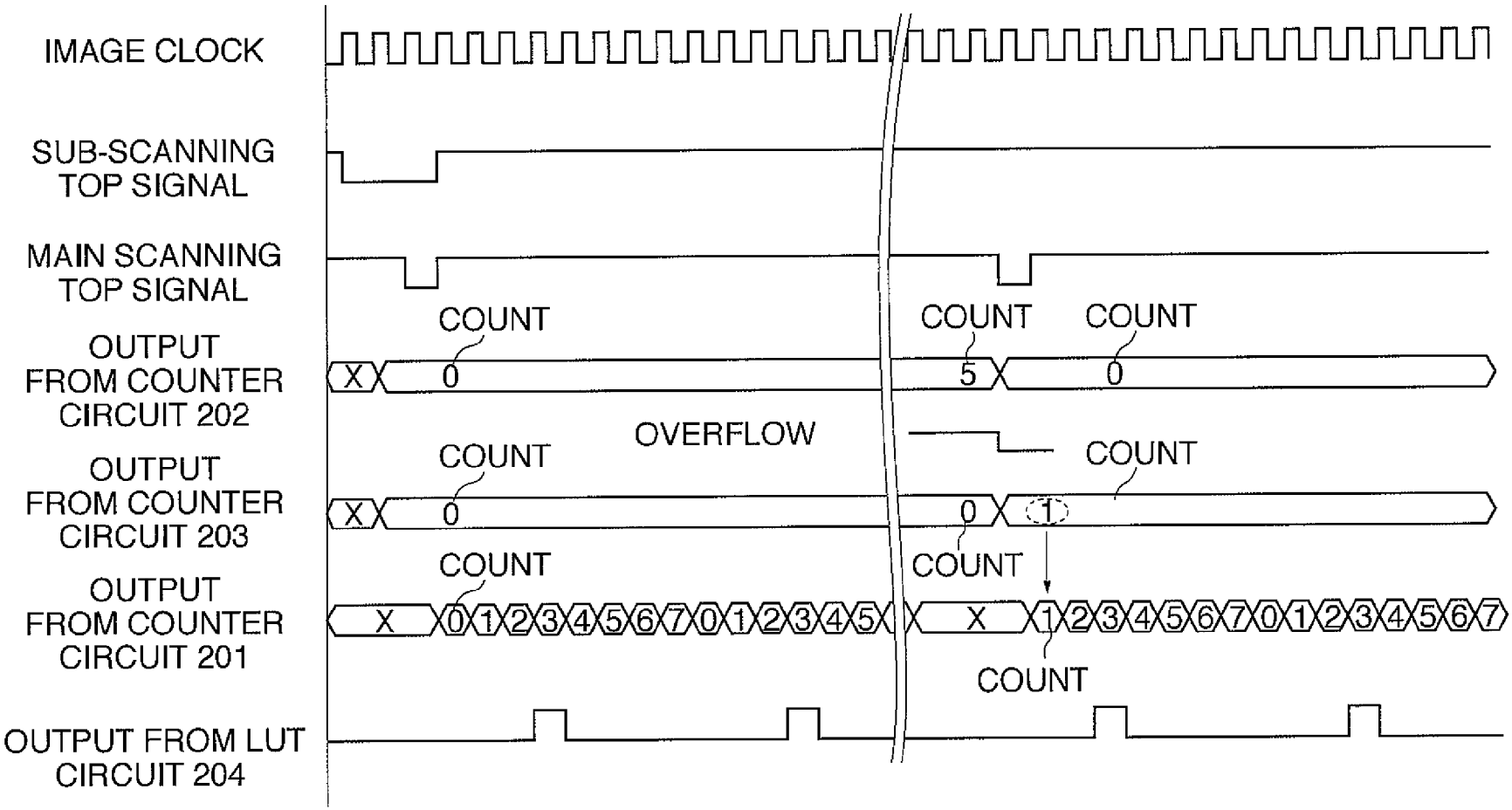
FIG. 7 is a timing chart showing the operation of the dot pattern forming section in FIG. 6.
Figure 8:
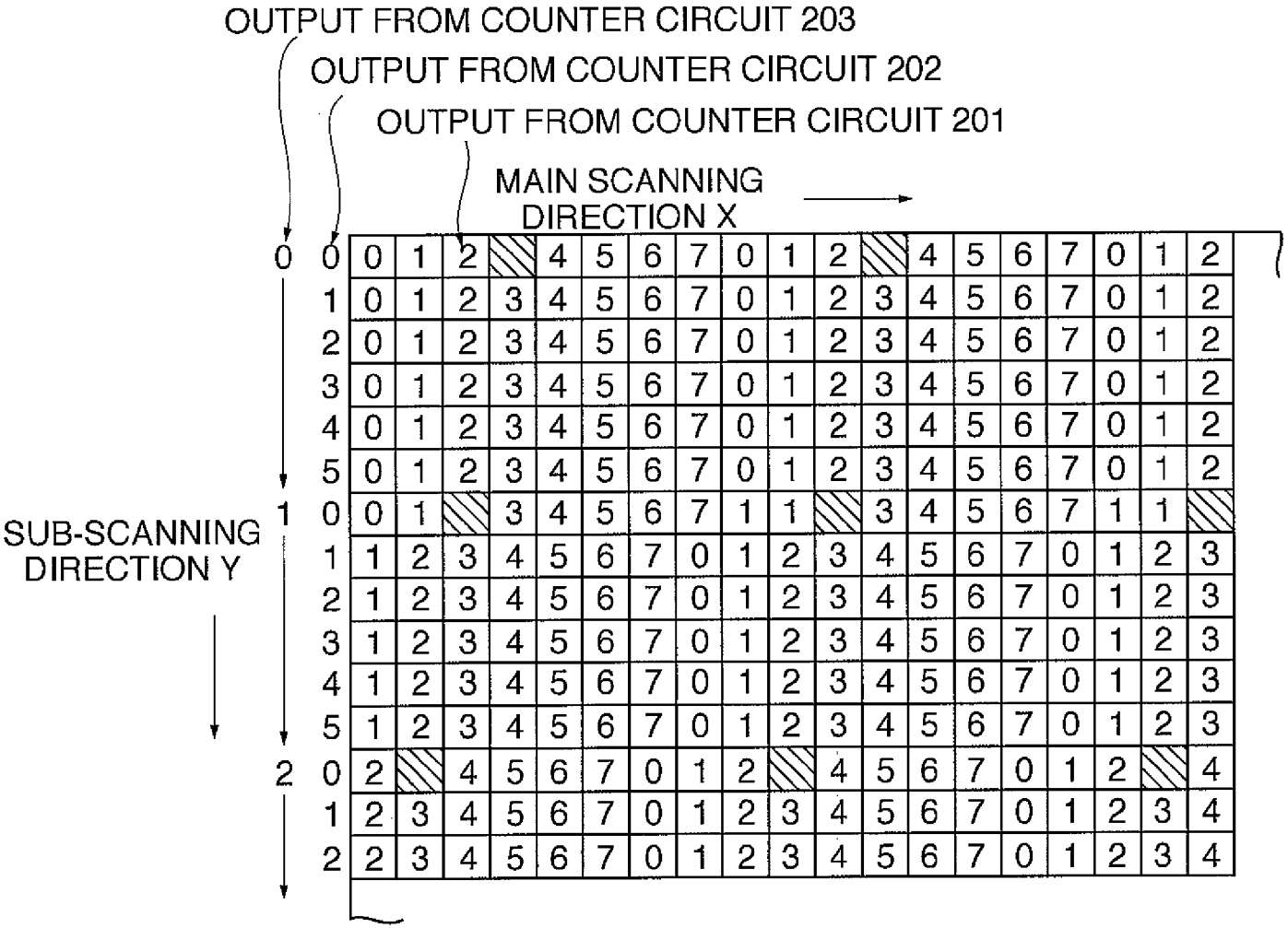
FIG. 8 is a diagram schematically showing positions at which dot toner images are formed in a part of an LM dot pattern.
Figure 9:
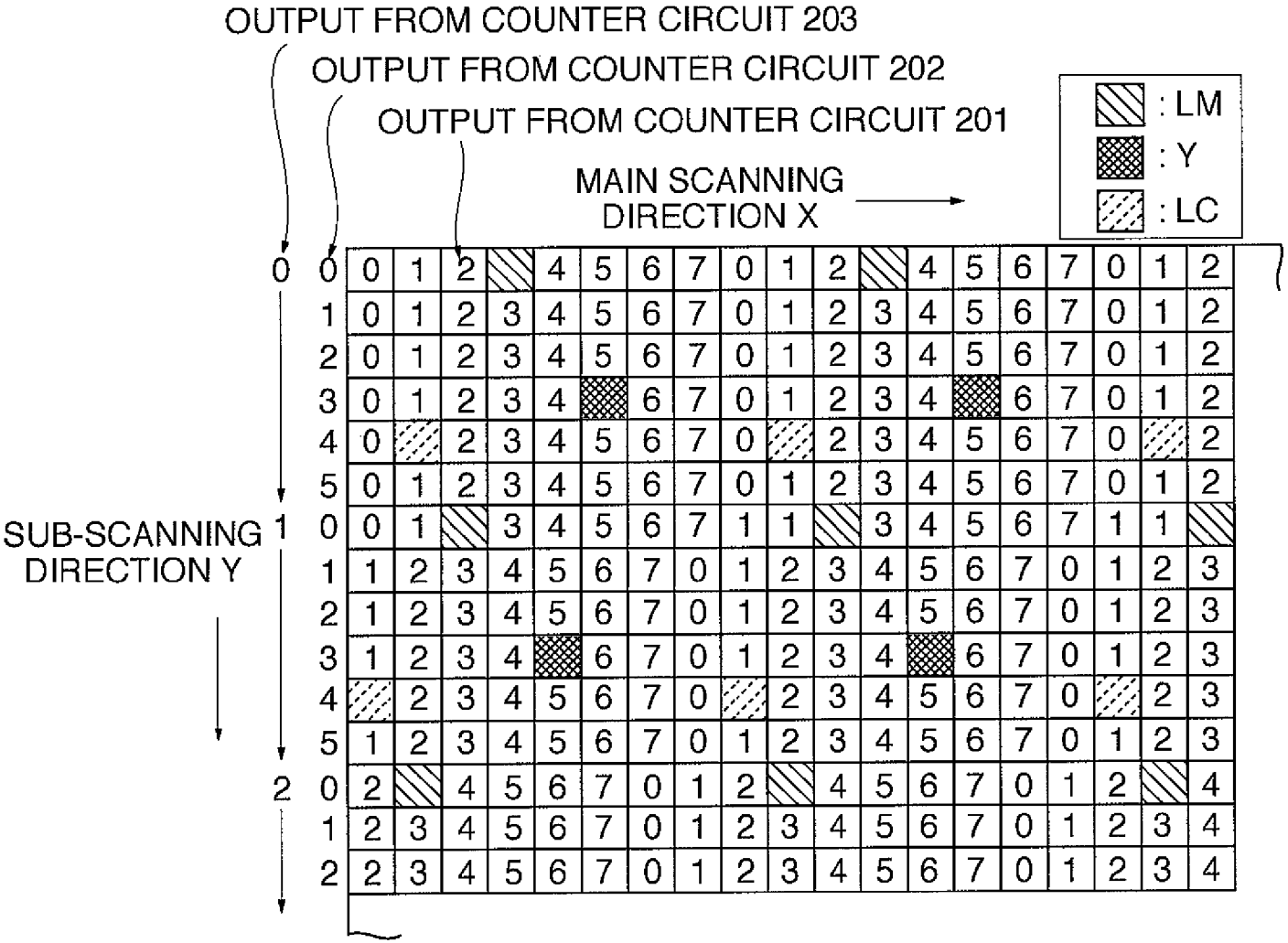
FIG. 9 is a diagram schematically showing a part of an area where dot patterns of respective colors LM, LC, and Y are superimposed.

Referring next to FIGS. 6 to 9, a description will be given of the construction and operation of the dot pattern forming section 106. FIG. 6 is a block diagram showing the construction of the dot pattern forming section 106 appearing in FIG. 4. FIG. 7 is a timing chart showing the operation of the dot pattern forming section 106 in FIG. 6. FIG. 8 is a diagram schematically showing positions at which dot toner images are formed in a part of an LM dot pattern. FIG. 9 is a diagram schematically showing a part of an area where dot patterns of respective colors LM, LC, and Y are superimposed.

As shown in FIG. 6, the dot pattern forming section 106 is comprised of a plurality of counter circuits 201, 202, and 203 and a LUT (look-up table) circuit 204. The dot pattern forming section 106 divides a sheet area into a plurality of rectangular dot areas. Then, the dot pattern forming section 106 forms at least one dot toner image of each color (LM, LC, or Y) in each of the dot areas to form a dot pattern of each color (LM, LC, or Y) in which dot toner images are diffused. In the present embodiment, the sheet area is divided into a plurality of dot areas each comprised of 8 dots×6 dots, and dot toner images of respective colors (LM, LC, and Y) are formed in each of the dot areas.

The counter circuit 201 is a counter which repeats counting from "0" to "7" using image clocks as input clocks so as to divide a sheet area into a plurality of dot areas in the main scanning direction X. An initial value indicative of the position of the leading end of the sheet area in the main scanning direction X is fetched into the counter circuit 201 in response to the input of a main scanning top signal (main scanning dot pattern area signal or signal synchronous therewith). Here, an output from the counter circuit 203 is fetched as the initial value. First, the counter circuit 201 performs counting from the fetched initial value to "7." After that, counting from "0" to "7" is repeated until the position of the trailing end of a dot pattern in the main scanning direction X is reached.

The counter circuit 202 is a counter which repeats counting from "0" to "5" using the main scanning top signals as clocks, and its count value is reset in response to the input of sub-scanning top signals. That is, each time counting in the main scanning direction by the counter circuit 201 is completed, the counter circuit 202 is incremented by one.

The counter circuit 203 is a counter for setting the initial value of the counter circuit 201 in shifting from one dot area to another in the sub-scanning direction. The counter circuit 203 uses the main scanning top signals as clock inputs and is incremented by one each time the counter circuit 202 resets its count value to "0" after counting from "0" to "5", i.e. each time the counter circuit 202 overflows. Upon receiving the main scanning top signal, the counter circuit 202 outputs its count value at that time to the counter circuit 201. Specifically, when the number of times of counting from "0" to "5" by the counter circuit 202 reaches six, the counter circuit 203 is incremented by one so as to shift from one dot area to another in the sub-scanning direction.

The LUT circuit 204 receives count values output from the counter circuit 201 and count values output from the counter circuit 202. The LUT circuit 204 holds a table for determining positions at which dot toner images are formed in dot patterns of the respective colors LM, LC, and Y. By referring to the table, the LUT circuit 204 regards combinations of count values input for the respective colors LM, LC, and Y and values corresponding thereto as the positions at which dot toner images of the respective colors LM, LC, and Y are to be formed, and outputs a dot pattern signal indicative of "0." In the present embodiment, (X, Y)=(3, 0) is set as the position at which a dot toner image is formed in an LM dot pattern. Also, (X, Y)=(1, 4) is set as the position at which a dot toner image is formed in an LC dot pattern, and (X, Y)=(5, 4) is set as the position at which a dot toner image is formed in a Y dot pattern. Thus, dot toner images of respective colors are formed at positions where they are not overlapped.

Referring next to FIGS. 7 and 8, a description will now be given of the operation of the dot pattern forming section 106 constructed as described above. The following description will be given of a case where an LM dot pattern is formed.

At the start of the formation of a dot pattern, a sub-scanning top signal is input to the counter circuit 202 and the counter circuit 203 as shown in FIG. 7. Also, a main scanning top signal is input as a clock input to the counter circuit 202 and the counter circuit 203 and input as a load input to the counter circuit 201.

The counter circuit 202 is reset in response to the input of the sub-scanning top signal and starts counting from "0" to "5" using the main scanning top signal as a clock input. The counter circuit 203 is reset in response to the input of the sub-scanning top signal and retains the count value "0" using the main scanning top signal as a clock input. The output from the counter circuit 202 is output to the LUT circuit 204.

In response to the input of the main scanning top signal, the counter circuit 201 fetches the count value of the counter circuit 203 as an initial value and starts counting using an image clock as a clock input. At the start of the formation of a dot pattern, the value "0" is fetched as an initial value into the counter circuit 201 since the count value of the counter circuit 203 is "0." Thus, first, the counter circuit 201 performs counting from "0" fetched as the initial value to "7" and then repeats counting from "0" to "7." The count value of the counter circuit 201 is output to the LUT circuit 204.

Upon receiving a count value X of the counter circuit 201 and a count value Y of the counter circuit 202, which correspond to a combination of numeric values set for the color LM, the LUT circuit 204 refers to the above-mentioned table and outputs a dot pattern signal indicative of the value "0." Here, when the relational expression (X, Y)=(3, 0) is satisfied, the above-mentioned dot pattern signal is output as described above. If the above relational expression is not satisfied, a dot pattern signal indicative of the value "0" is output.

Then, the counter circuit 202 completes counting to "5." Specifically, until the counter circuits 201, 202, and 203 overflow, they perform counting, and the LUT circuit 204 operates.

When the counter circuit 202 overflows, an overflow signal is output to the counter circuit 203. The counter circuit 203 is incremented by one in response to the overflow signal. That is, the counter circuit 203 increments its count value from "0" to "1" and retains the count value "1."

Here, the overflow of the counter circuit 202 means that the main scanning top signal has been input to the counter circuit 201 six times. That is, the first dividing into dot areas in the main scanning direction has been completed, and there has been a shift from one dot area to another in the main scanning direction. In response to the input of the seventh main scanning top signal, the counter circuit 201 then fetches the count value retained by the counter circuit 203, i.e. "1" as an initial value, and the counter circuit 201 performs counting from the initial value "1" to "7." Thereafter, the counter circuit 201 repeatedly performs counting from "0" to "7." In response to the setting of the above initial value in the counter circuit 201, the position at which a dot toner image is formed in the dot area is shifted one dot in a direction opposite to the main scanning direction X.

Each time there is shift from one dot area to another in the sub-scanning direction as described above, the position at which a dot toner image is formed is shifted one dot in the direction opposite to the main scanning direction X, and the positions at which dot toner images are formed are dispersed so that they are not arranged on the same straight lines with respect to the sub-scanning direction. Thus, the positions at which LM dot toner images (diagonally shaded areas) are formed are dispersed as shown in FIG. 8, for example.

Thus, if dot toner images are arranged on the same straight lines with respect to the sub-scanning direction, the problem that dot toner images transferred onto a sheet stand out can be solved. Also, smudging with vertical stripe on the surface of the secondary transfer roller 54, accumulation of toner at a particular position of the cleaning device 6, and so on can be prevented.

Although in the present embodiment, the position in which a dot toner image is formed is shifted one dot each time there is a shift from one dot area to another in the sub-scanning direction, the number of dot shifts is not limited to this. For example, assuming that the number of dot shifts is k when the size m of the dot area in the main scanning direction is 8 dots, such a value that the highest common factor of this value and the size m (8) of the dot area in the main scanning direction is 1, for example, the number of dot shifts may be 3, 5 and 7. In this case a well, the positions at which dot toner images are formed are dispersed so that they are not arranged on the same straight lines with respect to the sub-scanning direction.

Also, similarly to LM dot toner images, LC and Y dot toner images are formed at positions corresponding to values written in the table of the LUT circuit 204. When LM, LC, and Y dot toner images are thus formed, a dot pattern as shown in FIG. 9 is obtained.

Also, a dot pattern is not limited to the above described pattern, and positions at which dot toner images of respective colors are formed may be changed depending on the type of normal images, other conditions, and so on. This may be accomplished by changing the number of times of counting by each of the counter circuits or selecting corresponding values from the table of the LUT circuit. The arrangement for determining positions at which dot toner images are formed is not limited to the above described arrangement of the dot pattern forming section.

Also, although in the present embodiment, a dot pattern is formed to cover the entire sheet area, this is not limitative, but a dot pattern may be formed to cover an area between the leading end of a sheet area and an image area.

Since image stripes produced due to changes in the force of friction between the photosensitive drum 1 and the intermediate transfer belt 52 could be formed not only when a color image is formed but also when a monochrome image such as a K (black) image is formed, a high-quality image can be formed when a monochrome image is formed.

Figure 10:
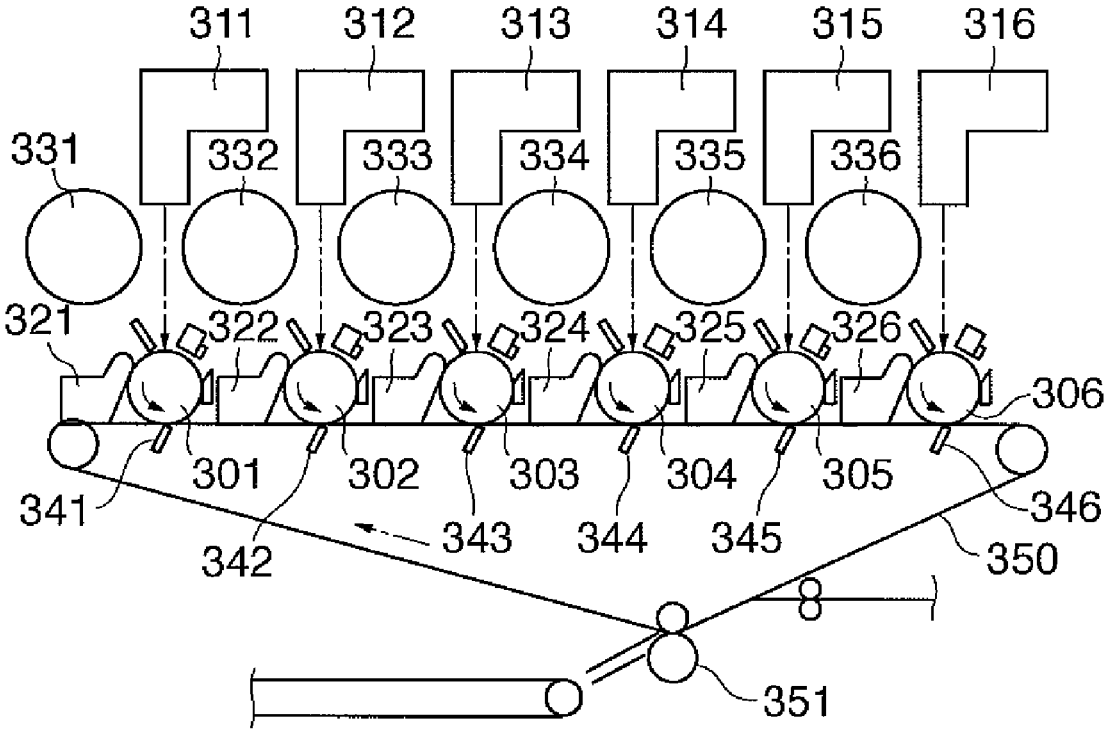
FIG. 10 is a longitudinal sectional view showing the construction of essential parts of a tandem image forming apparatus to which the principle of the present invention is applied.

Also, the principle of the present invention may be applied to, for example, a tandem image forming apparatus as shown in FIG. 10. The tandem image forming apparatus is comprised of a plurality of image forming stations for forming images of respective colors LM, LC, Y, M, C, and K. The image forming stations include photosensitive drums 301 to 306, exposure devices 311 to 316, developing devices 321 to 326, toner holding sections 331 to 336, and primary transfer devices 341 to 346. Toner images formed by the respective photosensitive drums 301 to 306 of the image forming stations are sequentially superimposed on an intermediate transfer belt 350 by the respective corresponding primary transfer devices 341 to 346 (primary transfer). As a result, a full-color toner image is formed on the intermediate transfer belt 350.

The full-color toner image formed on the intermediate transfer belt 350 is transferred onto a fed sheet by a secondary transfer roller 351 (secondary transfer). The sheet onto which the full-color toner image has been transferred is fed to a fixing device, not shown, and the full-color toner image on the sheet is pressed by heat and fixed onto the sheet. The sheet is then discharged from the image forming apparatus.

Also, the principle of the present invention may be applied to an image forming apparatus in which toner images formed on a photosensitive drum are transferred in a superimposed manner onto a sheet supported by a sheet conveying member in a case where the photosensitive drum and the sheet conveying member are driven in such a manner as to produce a difference in peripheral speed between them.

Also, in the arrangement that there is no difference in peripheral speed between a photosensitive drum and a transfer member, an unintended speed difference may be produced, for example, due to deflection of a drive roller. In such a case, image stripes may be produced as in the case where there is a difference in peripheral speed between the photosensitive drum and the transfer member, and hence the principle of the present invention may be applied to the arrangement that there is no difference in peripheral speed between the photosensitive drum and the transfer member.

It is to be understood that the object of the present invention may also be accomplished by supplying a system or an apparatus with a storage medium in which a program code of software, which realizes the functions of the above described embodiment is stored, and causing a computer (or CPU or MPU) of the system or apparatus to read out and execute the program code stored in the storage medium.

In this case, the program code itself read from the storage medium realizes the functions of the above described embodiment, and hence the program code and the storage medium in which the program code is stored constitute the present invention.

Examples of the storage medium for supplying the program code include a floppy disk, a hard disk, a magneto-optical disk, a CD-ROM, a CD-R, a CD-RW, a DVD-ROM, a DVD-RAM, a DVD-RW, a DVD+RW, a magnetic tape, a nonvolatile memory card, and a ROM. Alternatively, the program code may be downloaded via a network.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

Further, it is to be understood that the present invention may be applied to a case where a program code of software which realizes the functions of the above described embodiment may be distributed from a storage medium in which the program code is stored to a person who requests the program code via a communication line such as a computer online service.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2006-163862 filed Jun. 13, 2006, which is hereby incorporated by reference herein in its entirety.

What is claimed is:

1. An image forming apparatus comprising:

an image forming unit configured to form developed images on an image carrier using developers of respective different colors based on image information; and an intermediate transfer member onto which the developed images formed on the image carrier are transferred, wherein said image forming unit forms a plurality of minute dots by using at least two developers of different colors in a dispersed manner in an area where the developed image based on the image information is not formed, and wherein said image forming unit transfers the developed image based on the image information and the plurality of minute dots onto said intermediate transfer member.

2. An image forming apparatus according to claim 1, wherein the minute dots formed in the dispersed manner are formed in such a manner that the minute dots are not overlapped with each other.

3. An image forming apparatus according to claim 1, wherein there is a difference between a peripheral speed of the image carrier included in said image forming unit and a surface movement speed of said intermediate transfer member.

4. An image forming apparatus according to claim 1, wherein the minute dots formed by using the plural developers of different colors including at least one of a yellow developer, a light magenta developer, and a light cyan developer.

5. An image forming apparatus according to claim 1, wherein the minute dots are formed by using three developers of different colors.

6. An image forming apparatus according to claim 1, wherein the minute dots formed by using the plural developers of different colors including a yellow developer, a light magenta developer, and a light cyan developer.

7. An image forming apparatus according to claim 6, wherein an image configured by the minute dots is a grayish image.

8. An image forming apparatus according to claim 1, wherein said image forming unit forms the plurality of minute dots on an entire area corresponding to a size of a sheet to which the plurality of minute dots are transferred from said intermediate transfer member.

9. An image forming apparatus comprising:

an image forming unit configured to form developed images on an image carrier based on image information;

an intermediate transfer member onto which the developed images formed on the image carrier are transferred; and a transfer unit configured to transfer the developed images from said intermediate transfer member onto a transfer member, wherein said image forming unit forms a plurality of minute dots by using at least two different colors in a manner that minute dots of the different colors are each formed in a separate area where the developed image based on the image information is not formed and, wherein said image forming unit transfers the developed image based on the image information and the plurality of minute dots onto said intermediate transfer member.

10. An image forming apparatus according to claim 9, wherein said image forming unit forms the plurality of minute dots on an entire area corresponding to a size of a sheet to which the plurality of minute dots are transferred from said intermediate transfer member.

11. An image forming apparatus comprising:

an image forming unit configured to form developed images on an image carrier using developers of respective different colors based on image information; and an intermediate transfer member onto which the developed images formed on the image carrier are transferred, wherein said image forming unit forms a plurality of dots by using at least two developers of different colors in a dispersed manner in an area that the developed image based on the image information is not formed, and wherein said image forming unit transfers the developed image based on the image information and the plurality of dots onto said intermediate transfer member.

12. An image forming apparatus comprising:

an image forming unit configured to form developed images on an image carrier based on image information; and an intermediate transfer member onto which the developed images formed on the image carrier are transferred, wherein said image forming unit forms a plurality of dots by using at least two different colors in a manner that dots of the different colors are each formed in a separate area where the developed image based on the image information is not formed, and wherein said image forming unit transfers the developed image based on the image information and the plurality of dots onto said intermediate transfer member.

* * * * *